US005597121A

United States Patent [19]

Munezane et al.

[11] Patent Number: 5,597,121

[45] Date of Patent: Jan. 28, 1997

[54] FUEL INJECTION VALVE

[75] Inventors: Tsuyoshi Munezane, Hyogo; Norihisa Fukutomi; Osamu Matsumoto, both of Himeji, all of Japan

[73] Assignee: Mitsubishi Denki Kabushiki Kaisha, Tokyo, Japan

[21] Appl. No.: 385,423

[22] Filed: Feb. 8, 1995

Related U.S. Application Data

[63] Continuation-in-part of Ser. No. 219,361, Mar. 29, 1994, Pat. No. 5,411,212.

[30] Foreign Application Priority Data

Jun. 23, 1993 [JP] Japan ..... 5-151769

[51] Int. Cl.[6] ..... B05B 7/12

[52] U.S. Cl. ..... 239/408; 239/533.12

[58] Field of Search ..... 239/533.12, 410, 239/585.1, 408, 412

[56] References Cited

U.S. PATENT DOCUMENTS

| | | | |
|---|---|---|---|
| 3,656,693 | 4/1972 | Eckert | 239/410 |
| 4,519,370 | 5/1985 | Iwata | 123/432 |
| 5,129,381 | 7/1992 | Nakajima | 123/531 |
| 5,174,505 | 12/1992 | Shen | 239/417.3 |

*Primary Examiner*—Josie Ballato

*Attorney, Agent, or Firm*—Sughrue, Mion, Zinn, Macpeak & Seas

[57] ABSTRACT

An air fuel mixing portion 5A in an air fuel assist type fuel injection valve comprises a cylindrical upstream portion 5a including an air injection opening 3, and a cylindrical downstream portion 5b whereby dripping of fuel can be minimized. A spray angle of 30° or less is obtainable, and a rate of change in fuel flow between an air-injection time and a non-air-injection time can be reduced. Further, the relation between the diameter $D_1$ of the upstream portion and the diameter $D_2$ of the downstream portion is determined to be $D_1<D_2$.

2 Claims, 6 Drawing Sheets

FUEL INJECTION VALVE

This application is a Continuation-in-Part of application Ser. No. 08/219,361, filed Mar. 29, 1994 now U.S. Pat. No. 5,411,212.

BACKGROUND OF THE INVENTION

1. Field of the Invention

The present invention relates to a fuel injection valve used for an internal combustion engine. Particularly, it relates to an air assist type fuel injection valve.

2. Discussion of Background

FIGS. 6 through 8 are diagrams showing a conventional air assist type fuel injection valve disclosed in, for instance, Japanese Unexamined Patent Publication No. 264764/1991 wherein FIG. 6 is a longitudinal sectional view partly omitted showing an air injection system; FIG. 7 is a side view showing a fuel injection valve in FIG. 6, and FIG. 8 is a longitudinal cross-sectional view of an adapter main body for mixing air with fuel in the fuel injection valve shown in FIG. 7. In the Figures, reference numeral 1 designates an injector main body in an electromagnetic type fuel injection valve, numeral 2 designates an adapter main body attached to the bottom end portion 1*a* of the injector main body 1 to mix air with fuel, numeral 3 designates an air passage for air injection, and numeral 4 designates a fuel injection opening formed at the bottom end of the injector main body 1.

In operation, when an electric current is supplied to the injector main body 1, a needle valve is opened, and fuel is fed through the fuel injection opening 4 at the bottom end of the injector main body 1. At the same time, a predetermined amount of air is supplied to an air-fuel mixing portion 5 through the air intake passage 3 of the adapter main body 2 which is fixed to the bottom end portion la of the injector main body 1. Then, the fuel fed through the fuel injection opening 4 collides with air and is mixed with it in the air-fuel mixing portion 5, and the fuel becomes fine particles. The fuel is sprayed outside in the form of a mist. The shape of the mist is determined by the shape of the air-fuel mixing portion 5 formed in the adapter main body 2.

In the conventional air assist type fuel injection valve, since the shape of the air-fuel mixing portion 5 formed in the adapter main body 2 is cylindrical, there was a problem that atomized fuel deposits on the inner wall 6 of the air-fuel mixing portion 5, resulting in a liquid dripping phenomenon.

In order to prevent the disadvantage of the liquid dripping phenomenon, there was proposed that the ratio of the length L of the air-fuel mixing portion 5 to its inner diameter D was 1 or less. However, such technique increased a spray angle (30° or more) whereby the optimum shape of spray could not be obtained. Further, there was proposed such a technique that the air-fuel mixing portion 5 was formed to have a tapered shape as shown in FIG. 9. However, this technique had a problem that the rate of pressure change was increased at the fuel injection opening 5 between the time of injecting air and the time of non-injecting, although the occurrence of liquid dripping could be suppressed, so that the flow rate of fuel between the air-injection time and the non-air-injection time was largely changed (for instance, 5% or more) .

SUMMARY OF THE INVENTION

It is an object of the present invention to provide a fuel injection valve capable of reducing a rate of change in fuel flow at the time of injecting air to that at the time of non-air-injecting (for instance, 5% or less); minimizing a liquid dripping phenomenon and obtaining a spray shape having a small spray angle (30° or less).

The foregoing and other objects of the present invention have been attained by providing an air assist type fuel injection valve disposed in an air intake passage communicated with a combustion chamber in an internal combustion engine to apply air to fuel whereby the fuel is atomized, characterized in that the fuel injection valve has an adapter for mixing the fuel with air at its bottom end; the adapter includes an air fuel mixing portion having an air injection opening; and the air fuel mixing portion comprises a cylindrical portion whose inner diameter is larger than the length of the cylindrical portion and, in some embodiments, a tapered portion which is formed on the downstream side of the cylindrical portion with respect to the direction of fuel flow and is flared on the downstream side wherein the angle of the tapered portion is in a range from 10° to 60°.

In accordance with another feature of the invention, the relation of the inner diameter $D_1$ of the air-fuel mixing portion to the smallest diameter $D_2$ of the tapered portion at the downstream side of the air injection opening is determined to be $D_1<D_2$.

In another embodiment the downstream side portion is cylindrical rather than tapered, and defines a step or shoulder with the mixing portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(*a*) is similar to FIG. 5, showing a modification thereof;

DETAILED DESCRIPTION OF THE PREFERRED EMBODIMENTS

Figure 1:
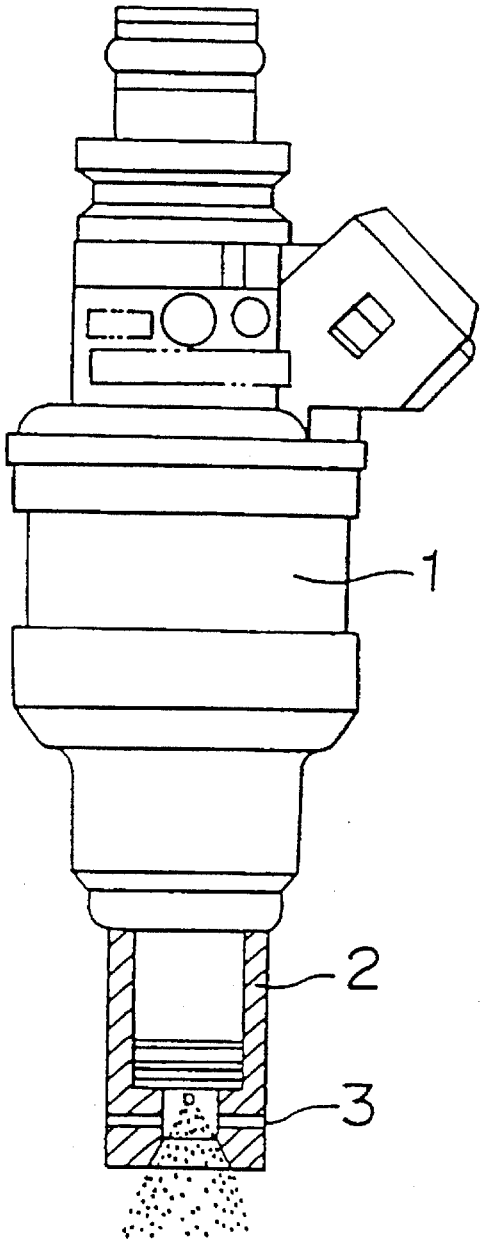
FIG. 1 is a front view partly cross-sectioned of a first embodiment of the present invention.

Preferred embodiments of the present invention will be described with reference to the drawings wherein the same reference numerals designate the same or corresponding parts.

Figure 2:
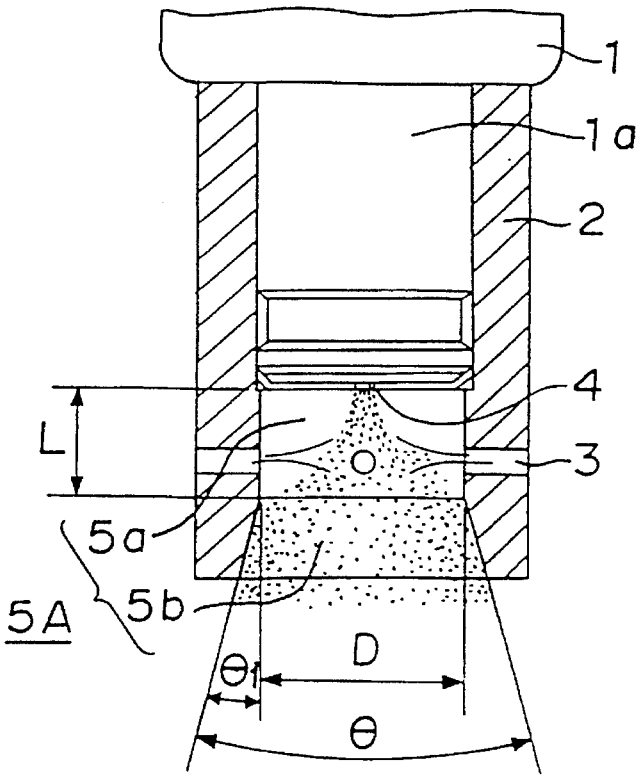
FIG. 2 is an enlarged cross-sectional view of an important portion in FIG. 1.

FIGS. 1 and 2 show a first embodiment of the fuel injection valve of the present invention. In FIGS. 1 and 2, reference numeral 5A designates an air-fuel mixing portion which is constituted by an upstream cylindrical portion *5a* and a downstream portion *5b* having a tapered shape. In this case, the shape of the cylindrical portion *5a* is so determined as to have a relation of L/D<1 (L: length and D: diameter) whereby a liquid dripping phenomenon caused by fuel deposited on the inner wall surface of the cylindrical portion *5a* can be suppressed. Further, the downstream portion *5b* is formed to have a tapered shape having a taper angle $\theta_1$=10°–60° whereby a spray angle θ can be small (30° or less). Further, the shape formed by combining the cylindrical shape and the tapered shape can reduce the rate of change of pressure at the fuel injection opening between the air-injection time and the non-air-injection time in comparison with a case that the air-fuel mixing portion *5a* is constituted by only a tapered shape. Accordingly, the occurrence of a liquid dripping phenomenon can be suppressed as well as reducing a rate of change in fuel flow.

Figure 3:
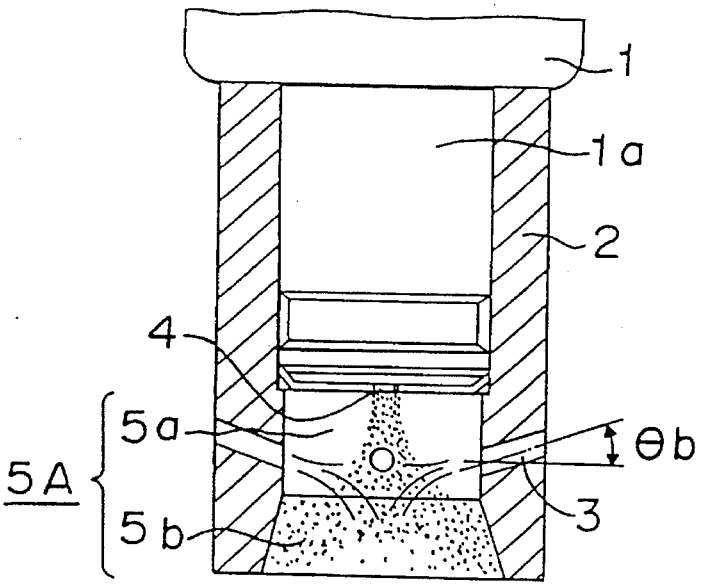
FIG. 3 is an enlarged cross-sectional view of an important portion according to a second embodiment of the present invention.

FIG. 3 shows a second embodiment of the present invention. In the second embodiment, the direction of injecting air through air intake passages 3 is determined to be an angle θb=20°–30° in the downward direction. In this case, a rate of change of pressure at the fuel injection opening between the air-injection time and the non-air-injection time can be further reduced. Accordingly, a rate of change in an amount of fuel flowing between the air-injection time and the non-air-injection time can be extremely small (for instance 1% or less).

Figure 4:
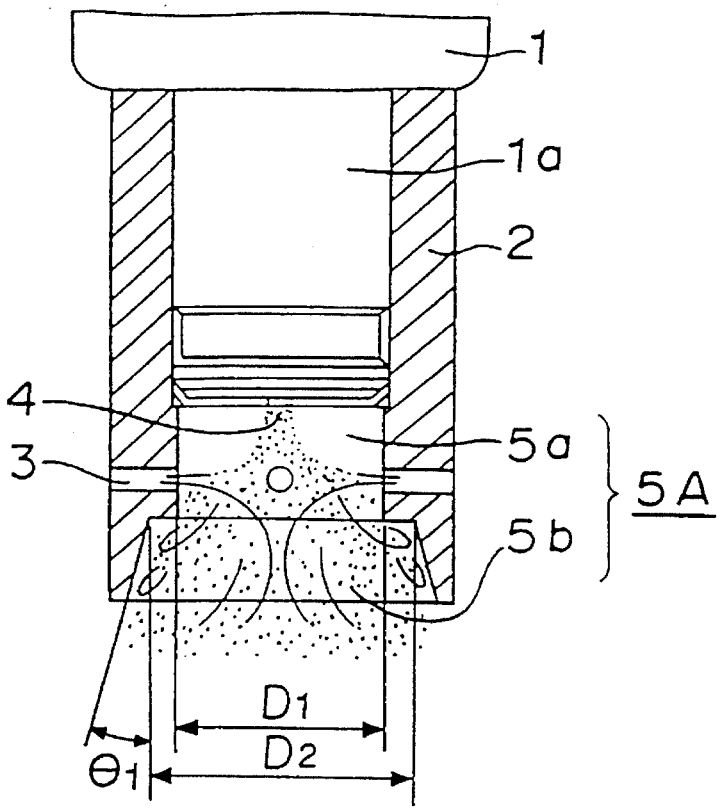
FIG. 4 is an enlarged cross-sectional view of an important portion showing a third embodiment of the present invention.

FIG. 4 shows a third embodiment of the present invention. In FIG. 4, the relation of the inner diameter $D_1$ of the cylindrical upstream portion *5a* of the air-fuel mixing portion 5A and the smallest diameter $D_2$ of the tapered downstream portion *5b* is determined to be $D_1<D_2$ so that a step is formed at the connection of the cylindrical portion and the tapered portion. With such a construction, vortices take place at or near the step whereby atomization of the fuel can be further accelerated.

Figure 5:
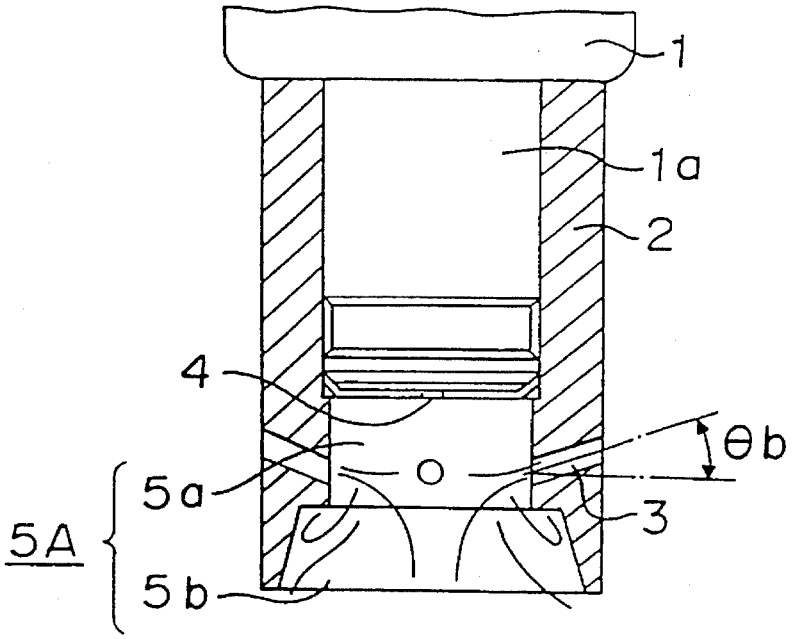
FIG. 5 is an enlarged cross-sectional view of an important portion showing a fourth embodiment of the present invention.
Figure 5A:
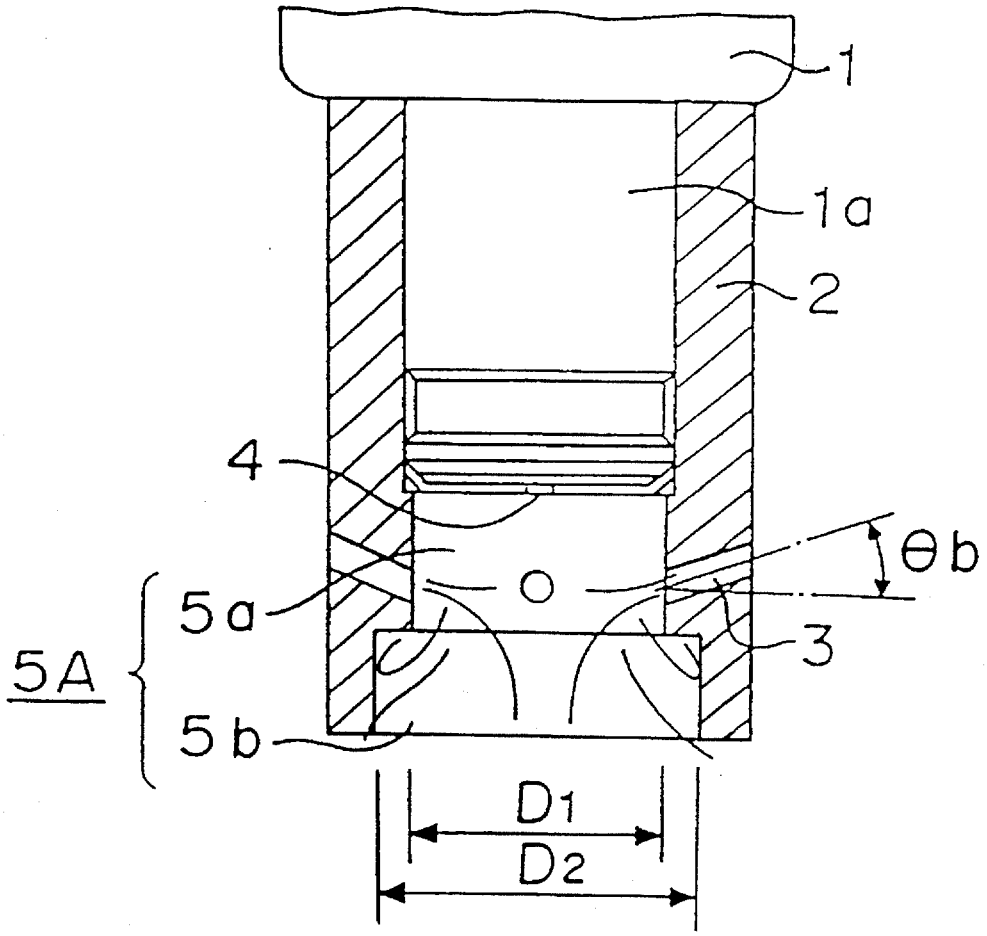
Figure 6:
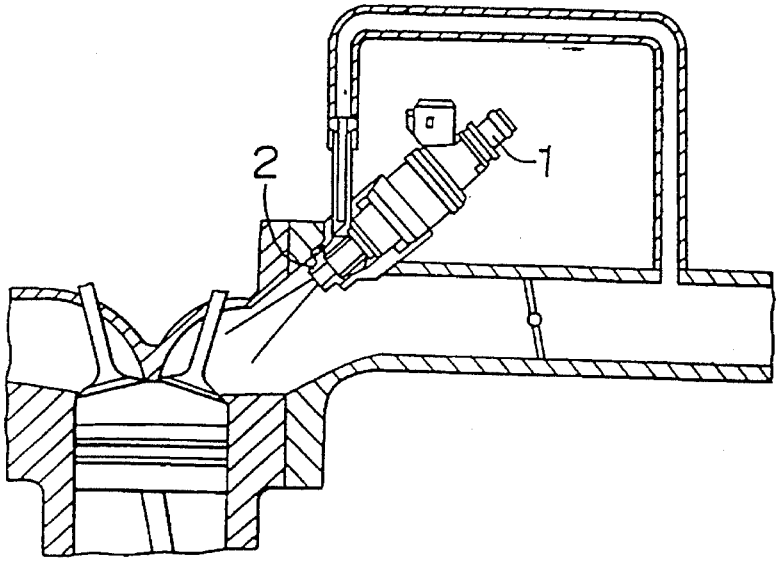
FIGURE 6 PRIOR ART
FIG. 6 is a diagram showing a conventional fuel injection system.
Figure 7:
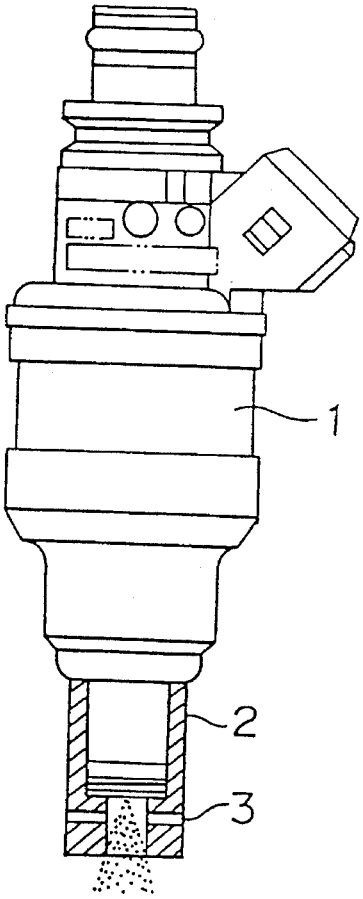
FIGURE 7 PRIOR ART
FIG. 7 is a front view of a fuel injection valve in FIG. 6.
Figure 8:
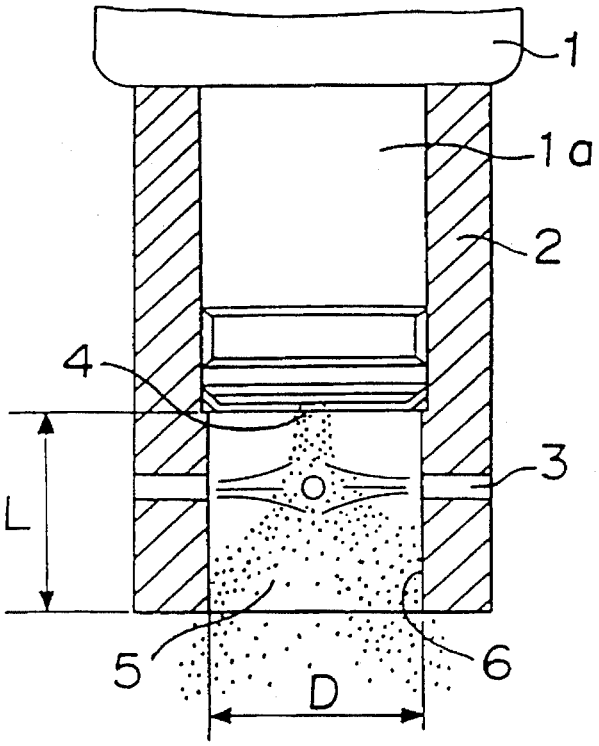
FIGURE 8 PRIOR ART
FIG. 8 is an enlarged cross-sectional view of an important portion of the fuel injection valve shown in FIG. 7.
Figure 9:
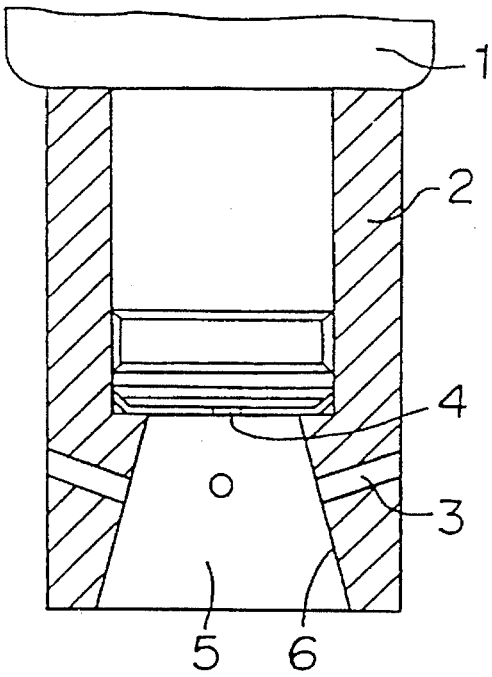
FIGURE 9 PRIOR ART
FIG. 9 is an enlarged cross-sectional view of an important portion of another conventional fuel injection system.

FIG. 5 shows a fourth embodiment of the present invention. A combination of the structures used in the second and third embodiments is used. Namely, the connection of the cylindrical portion and the tapered portion has a relation of $D_1<D_2$ and an angle of θb=20°–30° is provided for the air intake passage 3 in the downward direction. In the fourth embodiment, a rate of change in fuel flow in the air-fuel mixing portion between the air-injection time and the non-air-injection time can be substantially reduced (for instance, 1% or less).

FIG. 5(*a*) shows a fifth embodiment of the invention, similar to that of FIG. 5, where the downstream portion *5b* is cylindrical rather than being flared or tapered, and forms a step or shoulder where it joins the upstream mixing portion *5a*.

In accordance with the fuel injection valve of the present invention wherein an air-fuel mixing portion provided in an adapter is formed of a combination of a cylindrical portion and a tapered portion, there are advantages that a rate of change in fuel flow between an air-injection time and a non-air-injection time can be small and an excellent spray shape having a spray angle of 30° or less can be obtained. Further, fuel to be sprayed can be further atomized by determining the relation of the inner diameter $D_1$ of the cylindrical upstream side portion and the smallest diameter $D_2$ of the tapered downstream side portion of the air-fuel mixing portion to be $D_1<D_2$.

Obviously, numerous modifications and variations of the present invention are possible in light of the above teachings. It is therefore to be understood that within the scope of the appended claims, the invention may be practiced otherwise than as specifically described herein.

We claim:

1. An air assist type fuel injection valve adapted to be disposed in an air intake passage communicated with a combustion chamber in an internal combustion engine to apply air to fuel to atomize the fuel, wherein the fuel injection valve has an adapter at a bottom end thereof for mixing the fuel with air; the adapter including an air-fuel mixing portion into which an air injection opening opens; and the air-fuel mixing portion comprising a cylindrical upstream portion (*5a*) followed by a coaxial cylindrical downstream portion (*5b*), wherein an inner diameter $D_1$ of the upstream portion and an inner diameter $D_2$ of the downstream portion have a relation of $D_1<D_2$, wherein a connecting portion between the upstream and downstream portions defines an annular, outwardly directed shoulder substantially perpendicular to a common axis of said upstream and downstream portions, and wherein the air injection opening (3) is disposed in the upstream portion.

2. The fuel injection valve of claim 1, wherein the air injection opening is disposed at an inclined angle directed toward an outlet end of the valve.

* * * * *